US005083510A

United States Patent [19]

Hohlt

[11] Patent Number: 5,083,510

[45] Date of Patent: Jan. 28, 1992

[54] TRASH COMPACTOR AND WASTE MATERIAL CONTAINER

[76] Inventor: Kenneth W. Hohlt, 88 Hawthorne Est., Town and Country, Mo. 63131

[21] Appl. No.: 361,440

[22] Filed: Jun. 5, 1989

[51] Int. Cl.[5] ..... B30B 7/00

[52] U.S. Cl. ..... 100/100; 100/215; 100/229 A; 100/233; 100/255

[58] Field of Search ..... 100/229 A, 215, 100, 100/233, 252, 254, 255, 53

[56] References Cited

U.S. PATENT DOCUMENTS

| | | | |
|---|---|---|---|
| 3,544,120 | 1/1971 | Liberman et al. | 100/229 A |
| 3,575,103 | 4/1971 | Charles | 100/229 A X |
| 3,662,680 | 5/1972 | Palopoli et al. | 100/229 A |
| 3,662,910 | 5/1972 | Herpich et al. | 100/229 A X |
| 3,696,737 | 10/1972 | Wikner | 100/233 |
| 3,881,407 | 5/1975 | Goar | 100/229 A X |
| 4,088,071 | 5/1978 | Cruse et al. | 100/255 X |
| 4,235,165 | 11/1980 | Fenner et al. | 100/229 A X |
| 4,257,322 | 3/1981 | McDermott | 100/233 X |
| 4,271,756 | 6/1981 | Bettencourt | 100/233 X |
| 4,290,352 | 9/1981 | Schmidt et al. | 100/233 X |
| 4,393,767 | 7/1983 | Dutfield | 100/229 A |
| 4,424,740 | 1/1984 | Gwathney et al. | 100/229 A X |
| 4,603,626 | 8/1986 | Nall et al. | 100/229 A X |
| 4,804,289 | 2/1989 | Blough | 100/229 A X |

FOREIGN PATENT DOCUMENTS

| | | | |
|---|---|---|---|
| 2442050 | 3/1976 | Fed. Rep. of Germany | 100/233 |
| 564467 | 7/1975 | Switzerland | 100/229 A |
| 596980 | 3/1978 | Switzerland | 100/229 A |
| 1469804 | 4/1977 | United Kingdom | 100/233 |

*Primary Examiner*—Harvey C. Hornsby
*Assistant Examiner*—Stephen F. Gerrity

[57] ABSTRACT

An industrial-type compactor for a waste material container is disclosed. The compactor includes a supporting frame that receives the waste material container, with the supporting frame having a waste material channel that communicates with the waste material container. A waste compacting ram is pivotally supported at one end of the supporting frame for compacting waste materials. In order to keep the waste material within the waste material container during compacting, locking levers are operatively associated with the waste material container to maintain a pivotally mounted cover in a fixed and non-movable position atop the waste-material container. The locking levers are activated when the waste material container is positioned relative to the supporting frame. In addition, a door is operatively associated to the supporting frame for closing off the waste material channel during compacting.

19 Claims, 9 Drawing Sheets

TRASH COMPACTOR AND WASTE MATERIAL CONTAINER

BACKGROUND OF THE INVENTION

The present invention relates to a compactor for a waste material container, and more particularly, to an industrial-type compactor including an associated supporting frame and waste material container which facilitates the efficient compaction of trash materials within a waste material container, i.e., dumpster or the like.

In Western societies, trash has reached enormous proportions. The U.S. Environmental Protection Agency has estimated that Americans produced 160 million tons of solid trash in 1987. This is nearly 1300 pounds per person. Overall, municipal garbage has increased 80% since 1960 and is expected to increase 20% by 2000. Eighty percent of all trash is sent to landfills, 10% is incinerated and 10% is recycled, according to the EPA. Unfortunately, almost ⅓ of the nations landfills are expected to reach their limits within 5 years. Thus, the U.S. Environmental Protection Agency is seeking various strategies to reduce waste nationally over the next few years through reduction and recycling.

One way in which to achieve a reduction in waste is to compact waste material into a more compact shape. For this purpose, trash compactors have been developed for both home and industrial uses. In the home, a trash compactor generally comprises a vertically operated ram which moves within a trash compactor to compact the waste materials.

In the industrial environment, trash compactors have also been developed to include a vertically moving ram that compacts trash within a waste material container or dumpster, allowing trash to be contained in a smaller cubic foot of space. Examples of vertically operating rams in trash compactors are illustrated in U.S. Pat. Nos. 4,088,071 and 4,603,626. In addition to vertically moving rams, industrial-type waste compactors have also been developed which include a pivotally mounted ram that extends within a waste material container or dumpster to compact waste materials therein. Examples of pivotally mounted waste compacting rams are shown in U.S. Pat. Nos. 4,235,165 and 4,424,740.

While the aforementioned industrial-type trash compactors have simplified compacted waste dumping, have saved driver time and have substantially reduced maintenance cost, the efficiency of operation, the compactability of waste, and the cost of purchasing and operating such industrial-type trash compactors and associated waste material containers could be improved.

SUMMARY OF THE INVENTION

Accordingly, among the several objects and advantages of the present invention include:

the provision of an improved industrial-type trash compactor which improves the efficiency of operation, the compactability of waste, the safety of operation, the constant low loading height of 42" to conform to OSHA requirements, and the cost of producing and operating industrial-type trash compactors, as compared with prior art designs;

the provision of a compactor for a waste material container or dumpster wherein a pivotally mounted cover of the waste material container is maintained in a closed and non-movable position when the waste material container is received within a compactor supporting frame;

the provision of a door operatively associated with the supporting frame for closing a waste material channel of the supporting frame during waste compaction;

the provision of an improved hydraulic cylinder construction for a waste material compacting ram that provides increased compaction force for waste materials contained within the waste material container;

the provision of a waste material container and associated compactor supporting frame that facilitates assembly or disassembly relative to one another, while providing complementary interfitting elements to maintain the units in association with one another during compaction; and the provision of the aforementioned combined compactor and waste material container which is relatively economical to construct and assemble together; is extremely efficient in operation and use; is durable and long lasting; is kept closed during compaction and at other times to avoid problems associated with scavengers and rodents; is safe and easy to operate for the in-plant user as well as the driver of the waste disposal truck; and is otherwise well adapted for the purposes intended.

Briefly stated, the industrial compactor for a waste material container includes a compactor supporting frame which is constructed for receiving the waste material container within the supporting frame, with the supporting frame having a waste material channel extending therethrough. The waste material container includes an open upper end with a pivotally mounted cover extending at least partially across the open upper end. The waste material container also includes a waste material opening which communicates with the waste material channel of the supporting frame when the waste material container is received within the supporting frame. A waste compacting ram is pivotally supported at one end to the supporting frame and is operably positioned with respect to the waste material container for compacting waste therein. Locking means are operably associated with the waste material container for holding a pivotally mounted cover in a closed, non-movable position relative to the open upper end of the waste material container when received within the supporting frame. In addition, a door is operably positioned relative to the supporting frame for closing the waste material channel of the supporting frame during waste compaction.

The waste compacting ram is operable between an upper non-compacting position which provides clearance for waste material to be conveyed through the waste material channel into the waste material container, and a lower compacting position where the waste compacting ram compacts waste in the waste material container. The supporting frame includes spaced pairs of vertically extending structural supports on opposite sides of the supporting frame, and a spaced pair of hydraulic cylinders each being pivotally connected at one end to an associated interconnected structural beam between structural legs supports, in one of the pairs of structural legs supports, with an opposite end of the spaced pair of hydraulic cylinders being pivotally connected to the waste compacting ram. The pair of hydraulic cylinders are operated in substantially the same plane as the associated pair of structural legs support.

The locking means holding the pivotally mounted cover in a closed-non-movable position relative to the open upper end of the waste material container, are activated by the supporting frame when the waste material container is assembled thereto. The locking means comprises a pair of spring biased pivotally mounted locking levers which are mounted on opposite sides of the waste material container. Each locking lever is normally biased in a non-locking position relative to the cover and includes an activating rod connected to each locking lever which is supported by the waste material container shown on opposite sides thereof. Each activating rod is operably engaged by the supporting frame when the waste material container is received therewithin in order to cause its associated locking lever to pivot into locking engagement relative to the cover against the force of the spring associated therewith. Each locking lever includes a hook portion which overlies part of the cover, and each activating rod extends beyond the waste material container for corresponding engagement with the supporting frame when positioned relative thereto in order to move each locking lever in locking position relative to the cover.

The waste material container includes complementary interlocking means with the supporting frame for maintaining the waste material container and supporting frame assembled to one another during compaction. The complementary interlocking means preferably includes complementary interfitting elements associated with the waste material container and supporting frame. A bumper is attached to the waste material container in spaced relationship to the activating rods to support the waste material container in balanced relationship to the supporting frame when the activating rods operably engage the locking levers.

The supporting frame door is independently operated from the locking means in order to close the waste material channel. The waste material channel includes a generally vertically extending side opening, and the supporting frame door is operated in a generally vertically extending path adjacent the generally vertically extending side opening between an upper open position and a lower closed position. The supporting frame door is normally biased in the upper open position by springs associated therewith. Specifically, a pair of spaced pivotally mounted arms are each attached to an upper area of the supporting frame and have springs connected to pivotally mounted arms and the supporting frame. The door is connected adjacent an upper portion thereof to the other end of the pair of spaced pivotally mounted arms, and the door is constrained adjacent a lower portion thereof to move in a substantially vertical path in the supporting frame to close the generally vertically generally side opening of the waste material channel. The door is constrained to move in a generally vertically extending path by cooperating slot means provided in a pair of spaced structural leg supports that receive slidable elements attached to a lower portion of the door for the aforementioned constrained movement.

These and other objects and advantages of the present invention will become more apparent from the description that is to follow.

BRIEF DESCRIPTION OF THE DRAWINGS

In the drawings.

Corresponding reference numerals will be used throughout the various figures of the drawings.

DESCRIPTION OF THE PREFERRED EMBODIMENTS

Figure 1:
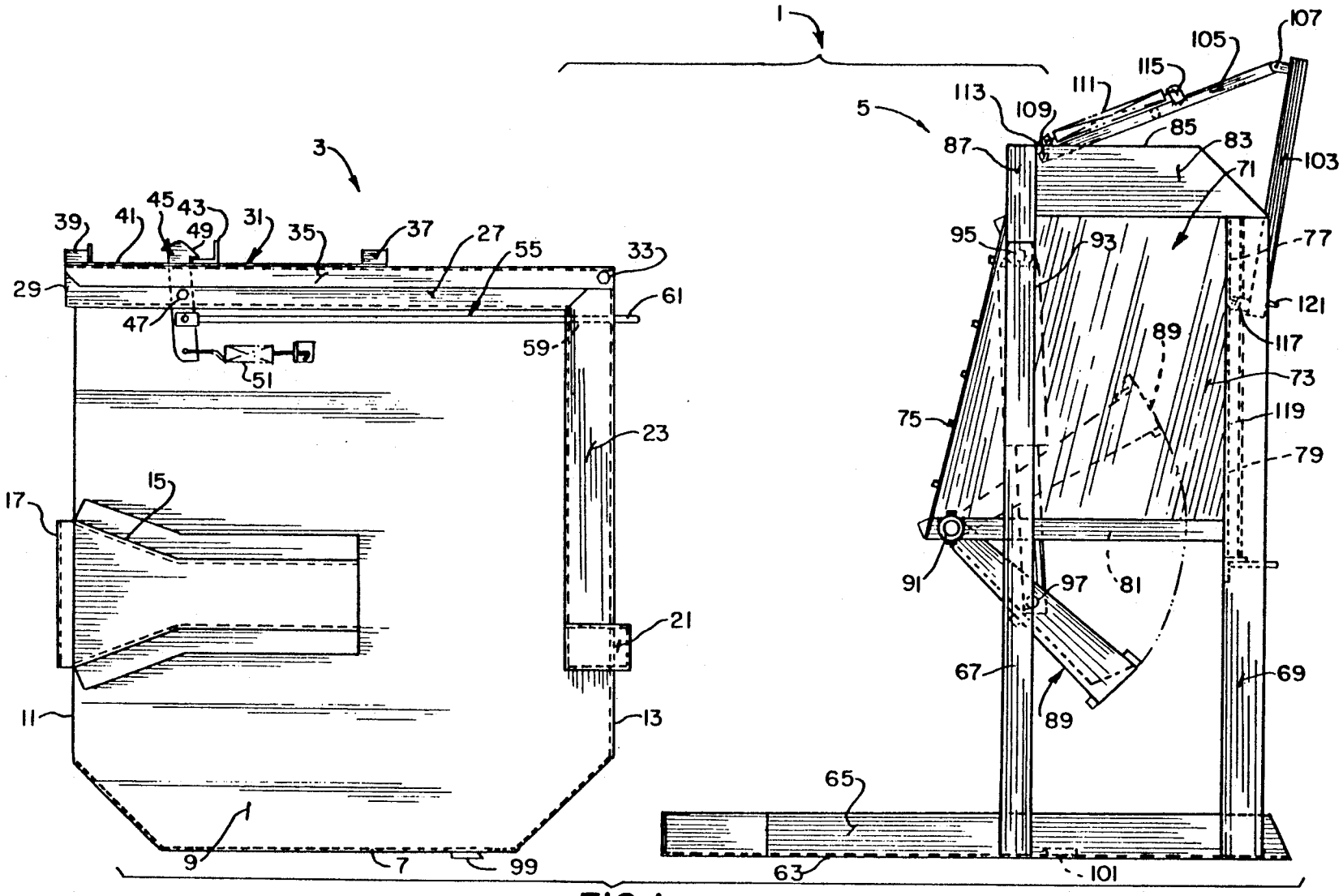
FIG. 1 is side elevational view of a trash compactor supporting frame and associated waste material container which are constructed in accordance with the teachings of the present invention, prior to being assembled relative to one another.
Figure 2:
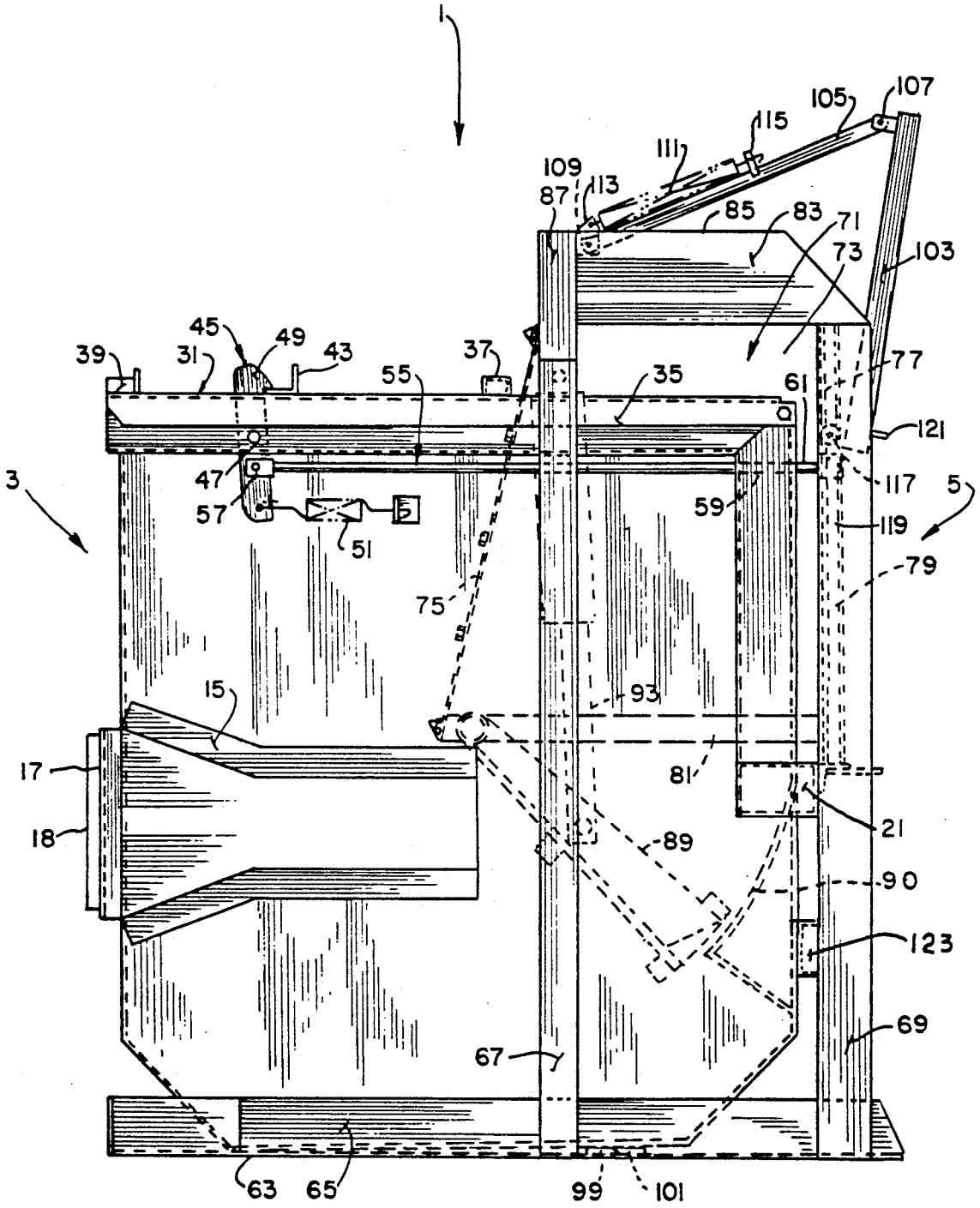
FIG. 2 is a side elevational view of compactor supporting frame and waste material container of FIG. 1, in assembled relationship to one another.

A combined compactor and waste material container 1 as shown in FIG. 2, includes the compactor unit 3 and the waste material container 5, also shown separated from one another in FIG. 1 of the drawings.

The waste material container 3 is constructed to contain waste or trash material therein, and the associated compactor 5 is constructed to compact waste materials within the waste material container 3. In general, such units have been previously developed in order to compact or tightly compress a variety of different packaging and other waste materials, so as to reduce the amount of space taken up by loosely packed waste or trash materials in a waste material receptacle or container.

Both the waste material container 3 and the compactor 5, forming the combined compactor and waste material container 1, are uniquely constructed as described below, in order to achieve the aforementioned objects and advantages of the present invention, as will be made apparent in the description that follows.

The waste material container or receptacle 3 is individually best seen in FIGS. 1 and 8–10 of the drawings. The waste material container 3 is typically formed from a series of metal plates or walls which are welded or otherwise secured together, including a bottom wall 7, upwardly extending opposed side walls 9, 9, a rear wall 11, and partial front wall 13, all of which are preferably welded together as a unitary body, as is well known. The bottom wall 7, adjacent the rear wall 11 and the partial front wall 13 inclines upwardly at an angle to the associated rear and partial front walls 11, 13 respectively. This facilitates assembly relative to the compactor 5, in the case of the inclined wall portion adjacent the partial front wall 13, and to avoid interference with the front loader truck, in the case of the inclined bottom wall portion 7 adjacent the rear wall 11. In addition, the outer inclined portions of the bottom wall 7 also cause trash or waste materials to move to the center of the container during initial filling thereof.

Each of the opposite side walls 9, 9 of the container 3 are provided with pockets 15, 15 which are of a welded metal construction for receiving the truck forks in a front loaded truck (not shown), allowing the waste material container 3 to be lifted relative to the truck and/or to facilitate positioning of same relative to the compactor 5. Adjacent the pockets 15, 15 on the rear wall 11 of the waste material container 3 are a series of bumpers 17, 17, with rubber bumper covers 18, 18 t o maintain a predetermined distance between the waste material container 3 and truck, in order to facilitate access to the open upper end of the waste material container 3 during emptying, as will become apparent.

The partial front wall 13 of the waste material container 3 extends vertically upwardly from the bottom wall 7 for only a short distance, the remaining portion constituting a front wall opening 19 which is surrounded by reinforcing elements. Specifically, a horizontally extending reinforcing beam and bumper 21 extends between the partial front wall 13 and the front wall opening 19, with vertically extending bars or reinforcing beams 23, 23 attached to each of the opposed side walls 9, 9 and also being innerconnected to the horizontally extending beam 21 at the lower end thereof, to reinforce the area surrounding the front wall opening 19. The horizontal beam and bumper 21 also serves to properly position the waste material container 3 relative to the compactor 5 when assembled thereto, as will become apparent.

At the upper end of the waste material container 3, defined by the innerconnected opposed side walls 9, 9 and the rear wall 11, is an open upper end 25 which also innerconnects with the front wall opening 19 for receiving waste or trash materials. Elongated reinforcing bars 27, 27 extend along the opposed side walls 9, 9 for reinforcing the open upper end, and are themselves innerconnected to a reinforcing bar 29 at the upper end of the rear wall 11. All of the bars 27, 27 and 29 serve to reinforce the open upper end opening 25 of the waste material container 3.

As will become apparent, the front wall opening 19, which opens up into the top wall or open upper end opening 25, is constructed for complementary association relative to a portion of the compactor 5, to be discussed hereafter, when the waste material container 3 and the compactor 5 are assembled together.

A pivotally mounted cover 31 extends at least partially across the open upper end 25 of the waste material container 3. Specifically, the pivotally mounted cover 31 is pivotally supported as at 33 to the reinforcing bars 23 and/or 27, and includes elongated extension arms 35, 35 which are pivotally supported at one end as at 33 and extend for substantially the entire length of the side walls 9, 9 in generally aligned and parallel line relationship to the upper reinforcing bars 27, 27. A pair of spaced horizontally extending reinforcing channels 37, 39 extend between the elongated arms 35, 35 of the cover 31 for reinforcing and strengthening same. The horizontal reinforcing bar 37 extends generally along a central area of the waste material container 3 while the horizontal reinforcing bar 39 is positioned adjacent the rear wall 11, as best seen in FIG. 1 of the drawings. An upper panel 41 is welded or otherwise secured to spaced elongated arms 35, 35 and the spaced horizontally extending bars 37, 39 to provide a closed panel or cover extending therebetween. The panel 41 is constructed to partially close the open upper end 25 of the waste material container 3 when the same is positioned within the compactor 5, as will be discussed.

An intermediate horizontally extending channel 43 also extends between pivotally mounted elongated arms 35, 35, not only to assist in strengthening the pivotally mounted cover 31 in the area of the panel section 41, but also to cooperate with locking levers 45, 45, for holding and maintaining the pivotally mounted cover 31 in a fixed and non-movable position when the waste material container 3 is received within the compactor 5.

The locking levers 45, 45 are each pivotally mounted at 47 to an upper reinforcing bar 27, at the upper end of each side panel 9. Each of the locking levers 45 includes a hook portion 49 for overlying the horizontal section of the channel 43, as shown in FIGS. 1–2 of the drawings. At an opposite end of each locking lever 45, it will be seen that a torsional spring 51 is connected thereto and also to an associated side wall 9, so as to normally bias the looking levers 45 in a normally open position. The elongated arms 35, 35 of the pivotally mounted cover 31 are provided with elongated slots 53, 53, enabling the pivoting locking levers 45, 45 to be moved to a non-engaged position relative to the channel 43. Thus, when the waste material container 3 is operated separately from and as an individual unit from the compactor 5, the locking levers 45 are normally biased to an open position, enabling the pivotally mounted cover 31 to swing open about the pivots 33 when the waste material container 3 is lifted and emptied by a front end loader dump truck (not shown), as will be apparent.

The locking levers 45 are constructed to be automatically moved to a locking or engaged position when the waste material container 3 is positioned in the compactor 5. Each of the activating arms 55 is connected at one end 57 to the locking lever 45 below the pivot 47 and extends through each reinforcing bar 23, in an opening 59 therein, and extends beyond the waste material container 3 as at 61 along the front wall and front wall opening 13, 19 thereof. The extended portions 61, 61 of each of the activating rods 55, 55 are positioned and arranged to engage upstanding structural leg supports of the compactor 5, to be further described hereafter, for the purpose of pivoting the locking levers 45 about the pivot 47 and against the torsional spring 51, so as to position the hook or nose portion 49 of the locking levers 45 in overlying engagement relative to the horizontal section of the channel 43, thereby holding the pivotally mounted cover 31 in a fixed and non-movable position relative to the upper end of the waste material container 3. This occurs only when the waste material container 3 is assembled within the compactor 5, so that during compaction of waste or trash materials within the waste material container 3, full and efficient compaction thereof will occur, without any escaping of waste materials from the waste material container 3.

Reference is now made to FIGS. 1–7 of the drawings for a description of the compactor 5 which is used in conjunction with the waste material container 3, to form the combined compactor and waste material container assembly 1.

The compactor 5 includes a pair of spaced base pads 63, 63 which may be mounted to a factory floor or the like. The base pads 63, 63 include spaced guiding sections 65, 65 to assist in guiding the waste material container 3, as best seen from the top plan view of FIG. 7. Each of the spaced guiding sections 65, 65 have a tapered entry section and an elongated shape to 5 for guiding the waste material container 3 with respect thereto Extending generally vertically upwardly from each of the base pads 63 are a plurality of spaced structural supporting legs comprising first and second pairs of spaced structural leg supports 67, 67 and 69, 69, respectively. The base pad 63 and associated guide sections 65 connect one of the first pair of legs 67 and second pair of legs 69 to each other on opposite sides of the compactor 5.

The first and second pairs of structural supporting legs 67, 67 and 69, 69 support a housing 71 which is spaced upwardly from the base pads 63, 63 and associated guide sections 65, 65 as best seen in FIG. 1 of the drawings. Housing 71 is complementary shaped relative to the front and top wall openings 19, 25, respectively, of the waste material container 3 so as to be substantially received therein, as shown in FIG. 2 of the drawings.

The compactor housing 71 is substantially hollow and includes spaced generally vertically directed side members 73, 73 which have a transverse dimension smaller than the lateral dimension of the front and top wall openings 19, 25 of the waste material container so as to be received therein. The rear panel member 75 is inclined from a vertical plane and is connected to the opposed spaced side panel members 73, 73 so as to provide a pivot for the waste compacting ram, to be discussed. The hollow housing 71 of the compactor 5 further includes a partial front wall panel 77, below which is constructed a front wall panel opening 79 to which a waste materials can be deposited to the hollow housing 71. The hollow housing 71 has an open bottom 81, thus providing a waste material channel including the front wall panel opening 79, the hollow housing 71 and the open bottom 81 of the hollow housing. When the hollow housing 71 of the compactor 5 is received within the waste material container 3, it will be appreciated that the aforementioned waste material channel cooperates with the front and top wall openings 19, 25 of the waste material container 3, allowing waste or trash material to pass through the compactor housing 71 and into the waste material container 3 for collection purposes.

On top of the hollow housing 71 is a tapered or sloping roof section 83 to close off the upper end of the housing 71 and further includes a generally horizontally extending roof or top wall 85. It will be noted that while the housing 71 is laterally spaced on opposite sides thereof from the first pair of spaced structural supporting legs 67, 67, to accommodate the waste material container 3 therein, the housing 71 is fixed or otherwise secured to the second pair of spaced structural supporting legs 69, 69 which are more closely positioned to one another than the first pair of structural supporting legs 67, 67. In addition, the hollow housing 71 is structurally supported by the legs 67, 67 and 69, 69 along or adjacent to an upper part thereof. Specifically, an innerconnecting structural beam 87 extends between the spaced structural supporting legs 67, 67 and is attached or otherwise secured to the upper roof section 83 of the housing 71, as best seen in FIG. 1-2 of the drawings. Also, it will be seen that the second pair of structural supporting legs 69, 69 are also attached to the roof section 83 so as to structurally interconnect the supporting legs 67, 67 and 69, 69 not only along the spaced base pads 63, 63, but also along the upper roof section 83, as above described. The hollow housing 71 further includes a waste compacting ram 89 which is pivotally mounted at 91 to an enlarged or extended portion of the housing 71 formed by the rear panel members 75 and side panel members 73, 73, as illustrated in FIG. 1. The waste compacting ram 89 is operated from an upper position within the waste compacting ram 71,, allowing waste or trash material to be pass through the waste material channel therein, to a lower compacting position extending outside of the hollow housing 71, for engaging and compacting waste or trash materials contained within the waste material container 3. Note also that an interior deflector shield 90 is provided adjacent the free end of the waste compacting ram 89 to prevent trash from getting on top of the ram 89, and also to assist in compaction. The dotted line position of the waste compacting ram 89 represents the upper extent of travel of the waste compacting ram 89, and full line position, as seen in FIG. 1, represents the type of movement or compacting force available. It will, of course, be understood that the waste compacting ram 89 may be moved further than the extended position shown in the full line representation of FIG. 1 by moving same further about the pivot 91, if desired.

In order to move the waste compacting ram 89 in its aforementioned range of movement, a pair of hydraulic cylinders 93, 93 are employed. Each hydraulic cylinder 93 is pivotally supported by a pair of depending ears and pivot pin connection 95 extending from the innerconnecting structural beam 87 at an upper end thereof, and at an lower end are pivoted as 97 approximately along the central or mid-portion of the waste compacting ram 89. It will be further noted that the spaced hydraulic cylinders 93, 93 are generally aligned with the spaced first pair of structural supporting legs 67, 67, which are generally vertically directed, such that the downward and upward moving force supplied to the waste compacting ram 89 is dynamically efficiently directed to obtain maximum desired compacting force.

When a front end load dump truck or fork lift truck position the waste material container 3 relative to the compactor 5, the bottom wall 7, at the juncture with the juxtaposed side walls 9, 9 in the waste material container 3 has spaced upwardly directed recesses 99, 99 for complementary interfitting and interlocking association relative to upstanding bosses 101, 101 provided in the spaced pads 63, 63 adjacent the structural leg supports 67, 67, as best seen in FIGS. 1-2 of the drawings. This maintains the waste material container 3 in assembled relationship to the compactor 5, allowing the waste compacting ram 89 to operate within the waste material container 3 for compacting waste or trash material. Also, as explained above, the extended portions 61, 61 of each of the activating rods 55, 55 attached to the locking levers 45, 45 are positioned to engage the spaced structural leg supports 69, 69, as shown in FIG. 2, thus causing the locking levers 45, 45 to pivot about the pivot support 47 thereof so as to lock the pivotally mounted cover 31 in fixed and non-movable relationship to the waste material container 3. As seen in FIG. 2 of the drawings, the housing 71, including the inclined rear wall panel 75 is fully received within the front and top wall openings 19, 25 of the waste material container 3, such that waste or trash materials compacted by the waste compacting ram 89, operating within the aforementioned closed waste material container 3, and in association with the compactor 5, provides efficient and complete compaction of waste material, as will be appreciated.

It is also desirable to close the front panel member opening 79 in the hollow housing 71 when compaction is occurring. For this purpose, a supporting frame door 103 is moved from an upper open position as seen in the drawings to a lower closed position closing the front panel member opening 79. This not only provides safe and efficient compaction of waste materials, but prevents any animals or rodents from entering into the combined compactor and waste material container 1 during the compaction operation.

Figure 3:
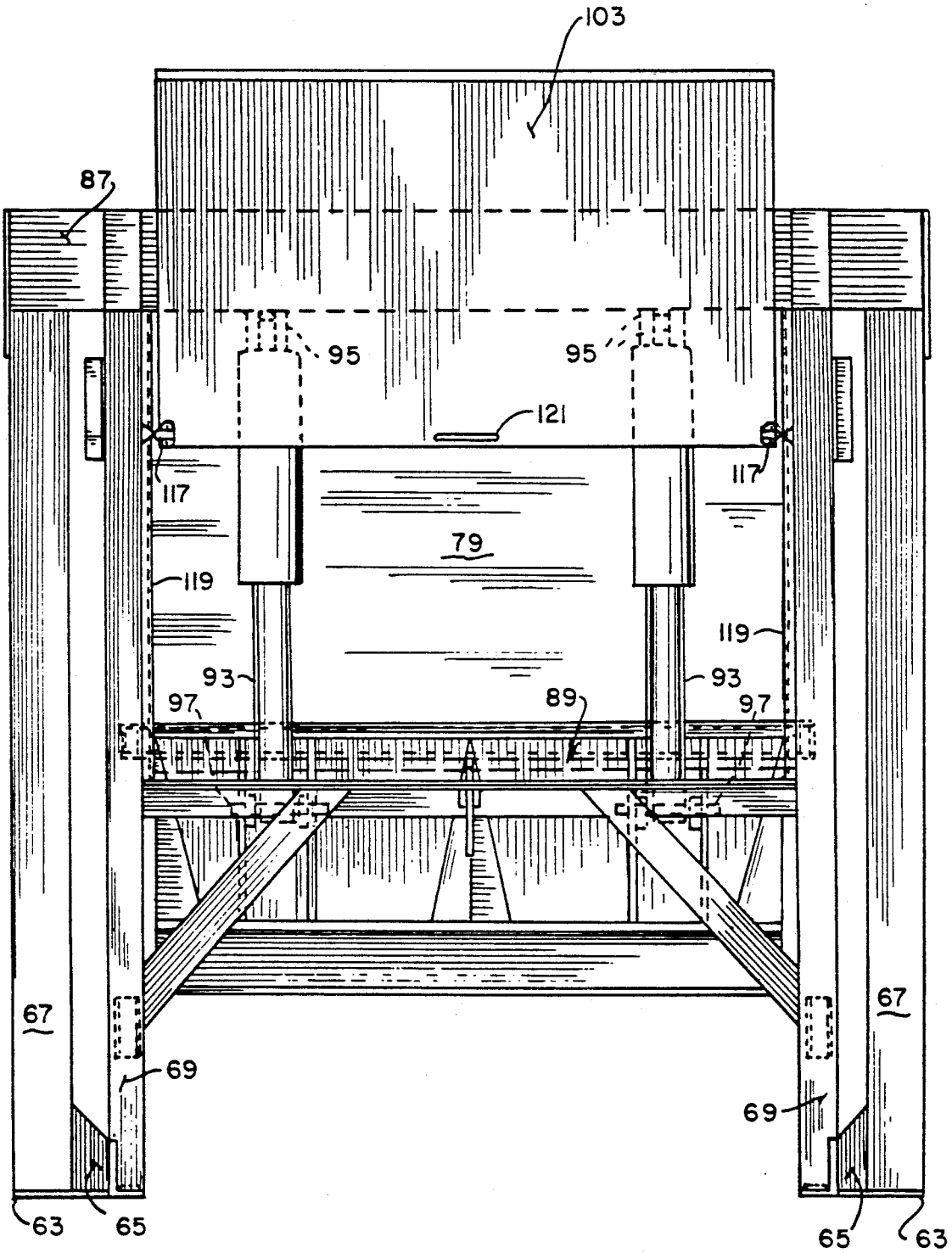
FIG. 3 is a front elevational view of the trash compactor supporting frame.
Figure 4:
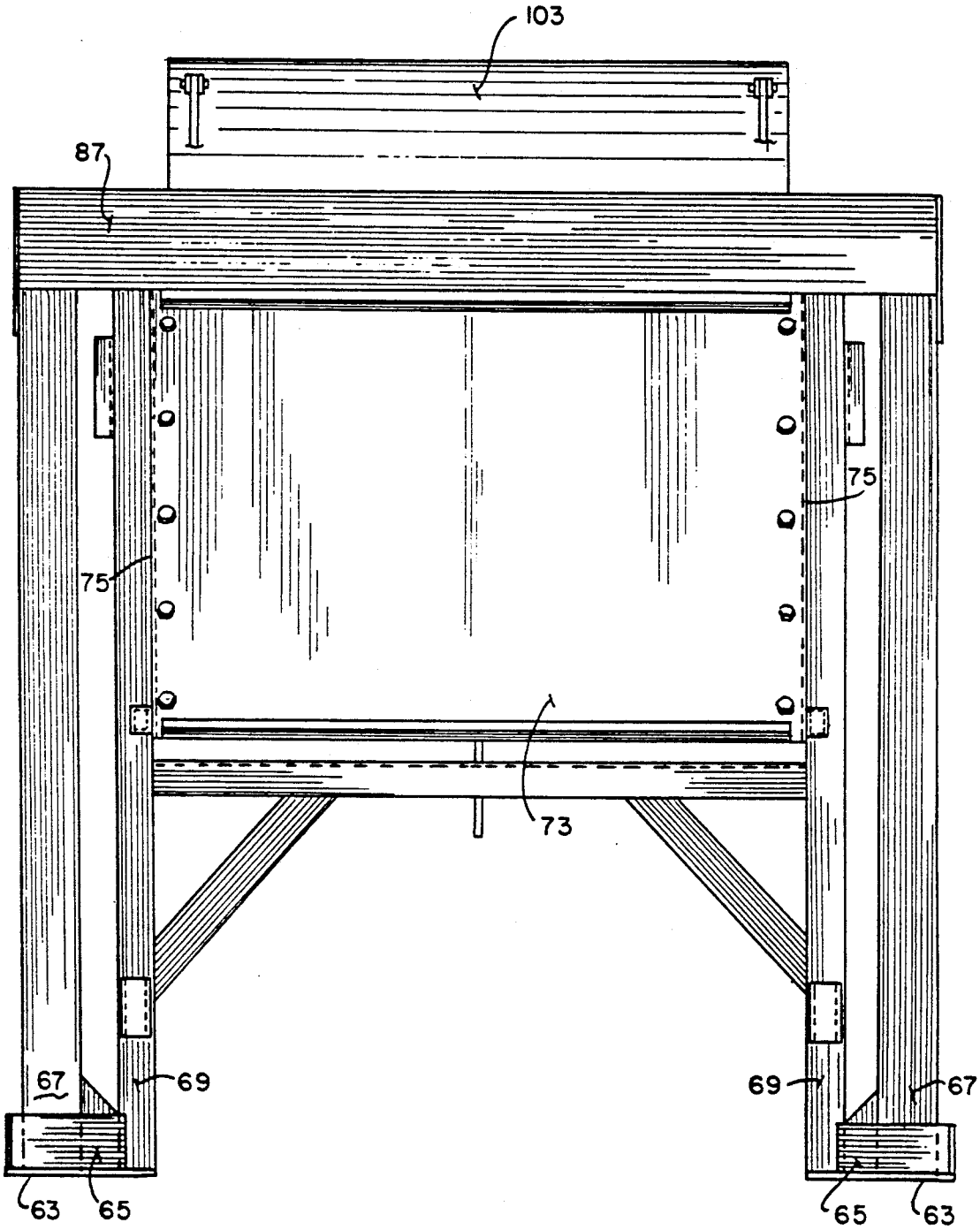
FIG. 4 is a rear elevational view of the trash compactor supporting frame.
Figure 5:
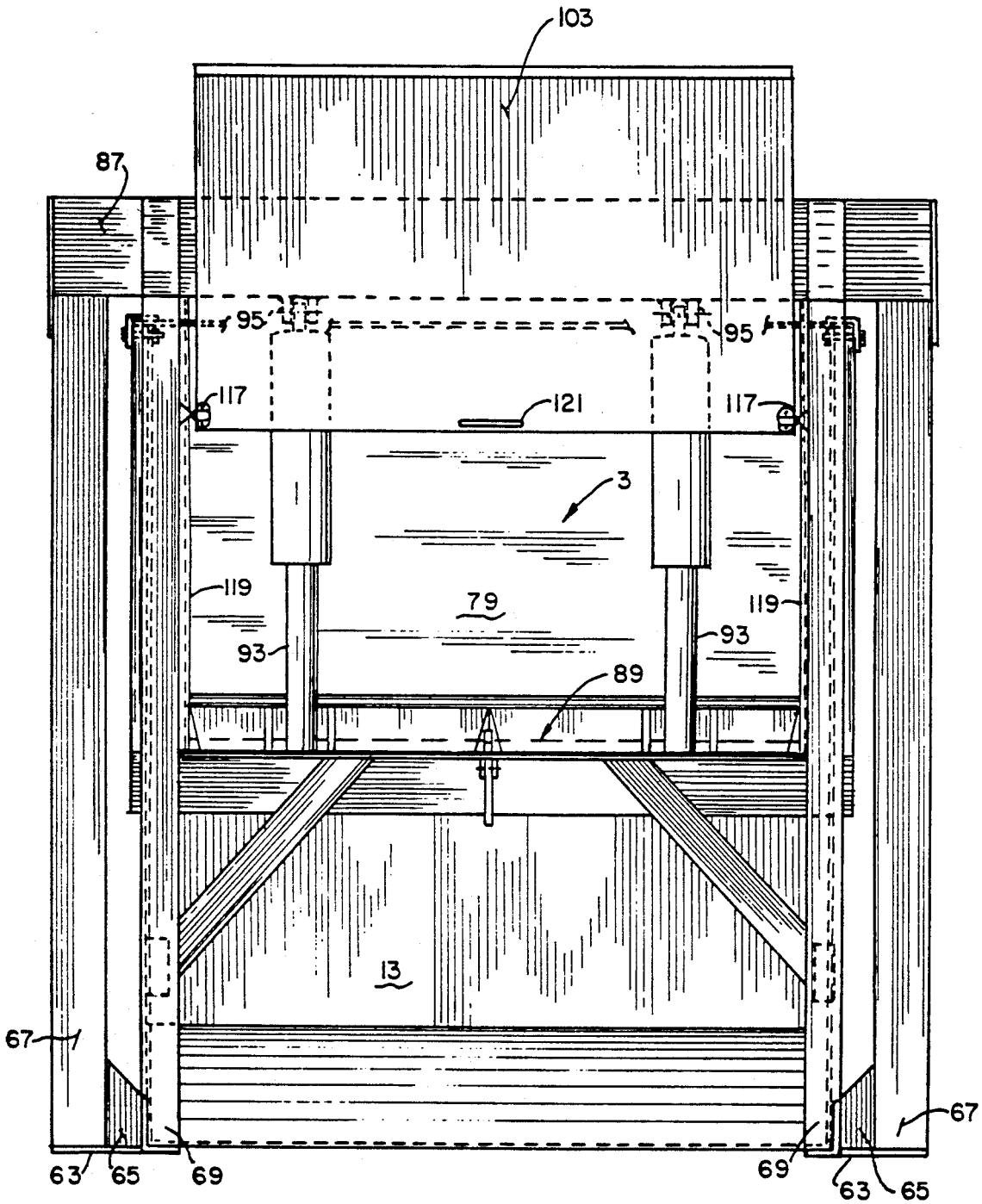
FIG. 5 is a front elevational view of the compactor supporting frame with the waste material container assembled thereto.
Figure 6:
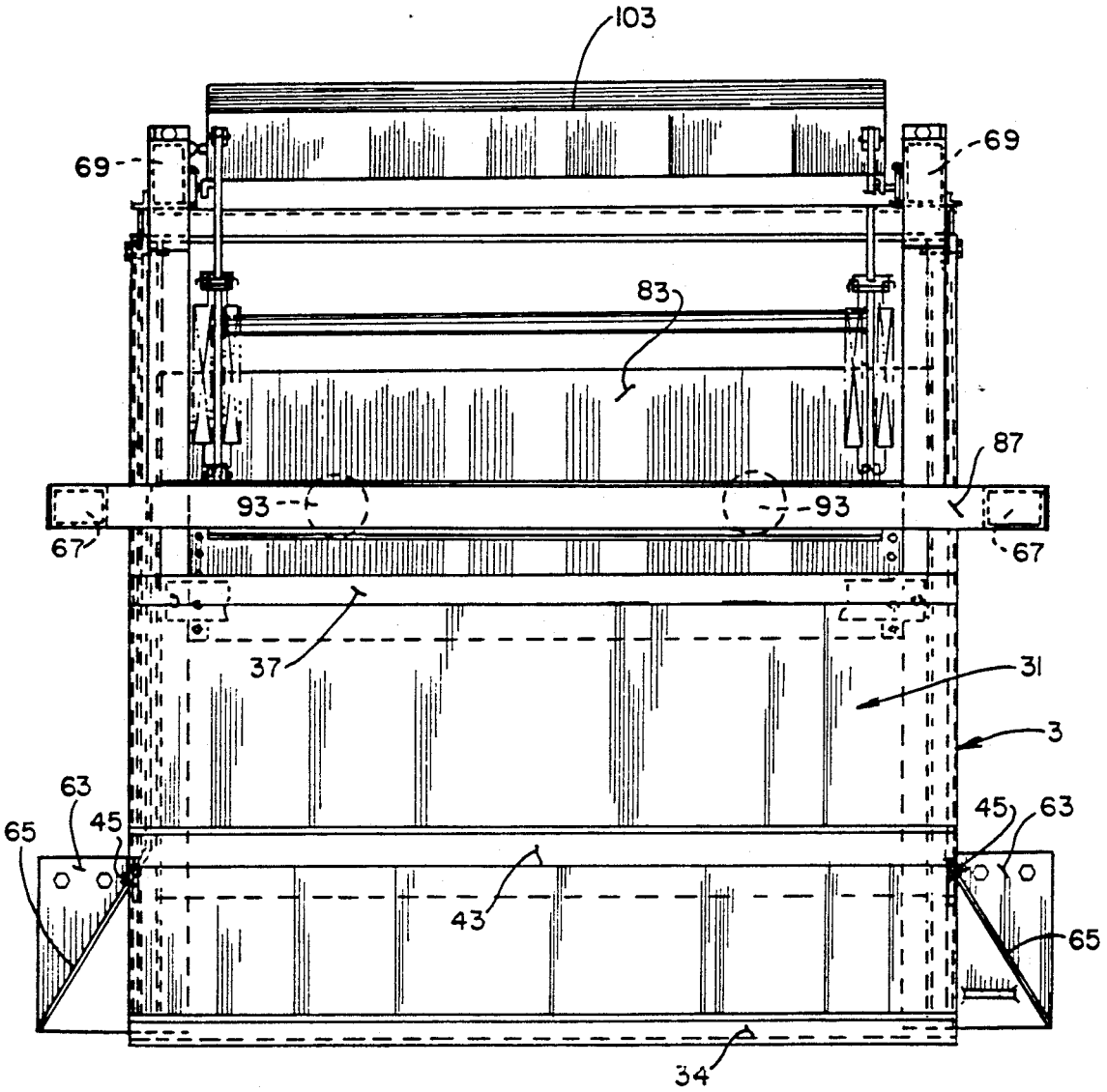
FIG. 6 is a top plan view of the trash compactor supporting frame and associated waste material container in assembled relationship to one another, as seen in the side elevational view of FIG. 2.
Figure 7:
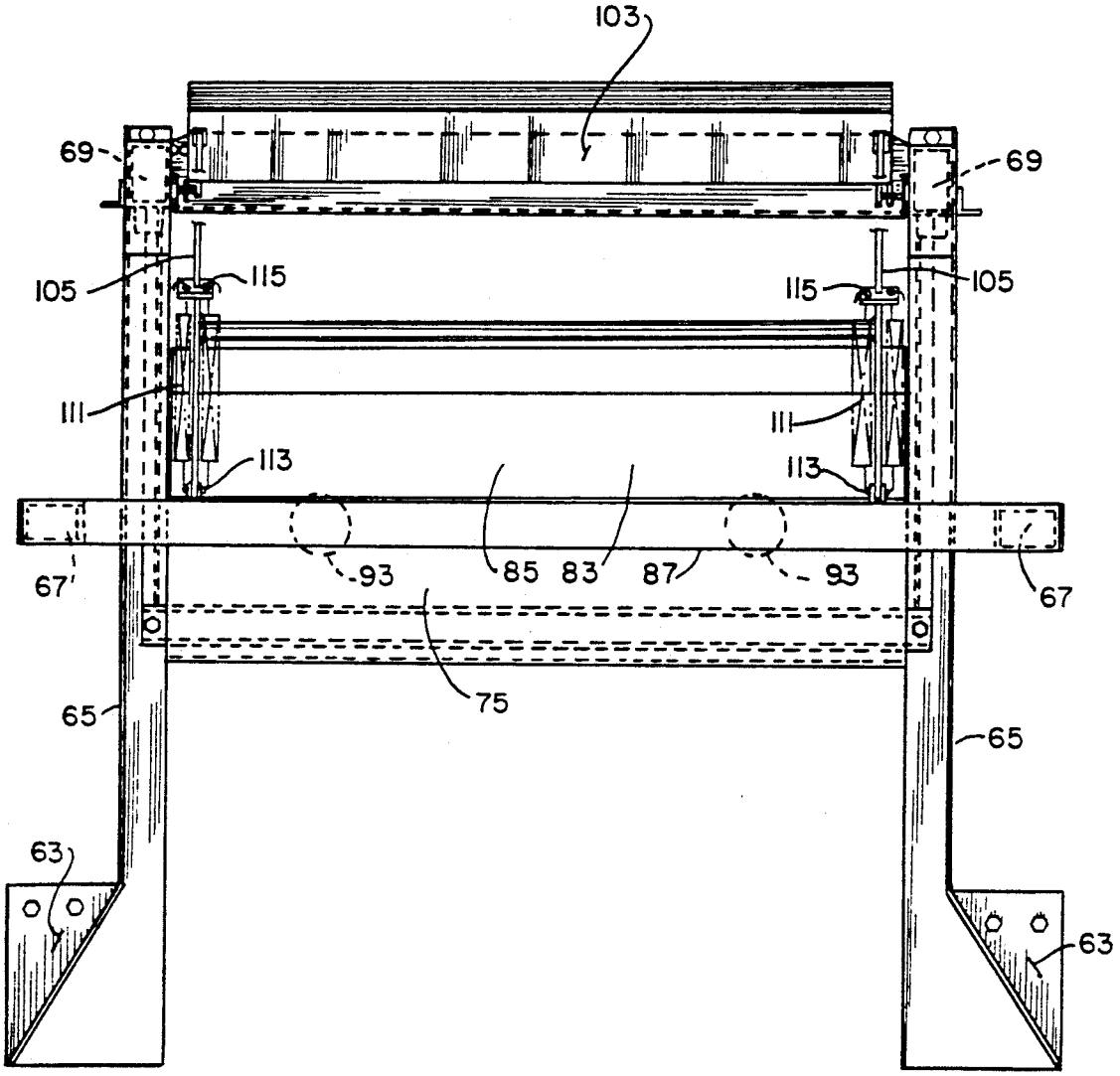
FIG. 7 is a top plan view of the trash compactor supporting frame by itself.
Figure 9:
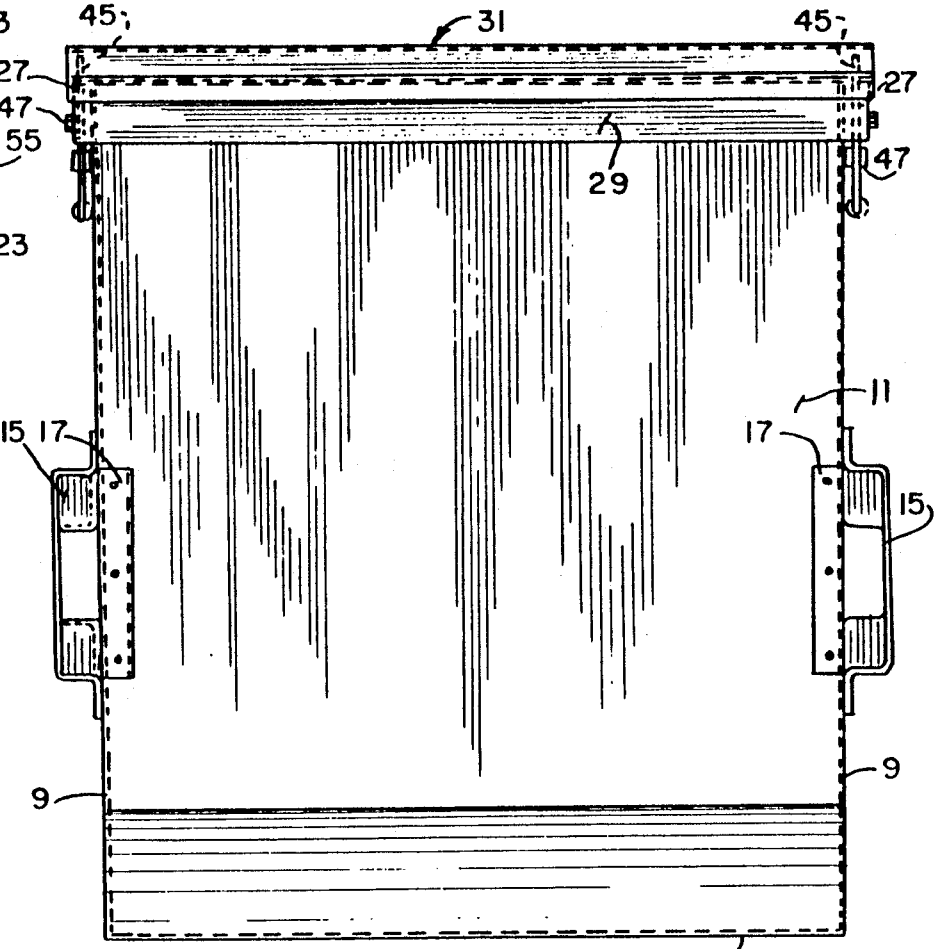
FIG. 9 is a rear elevational view of the waste material container by itself.
Figure 8:
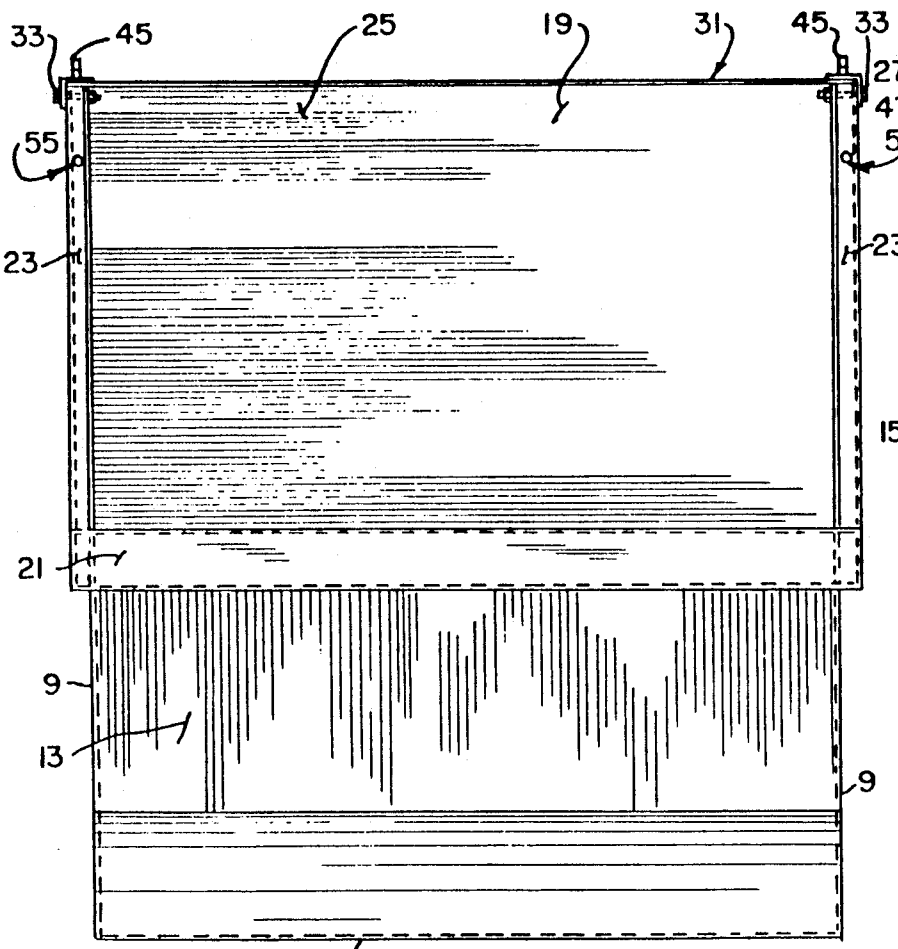
FIG. 8 is a front elevational view of the waste material container by itself.
Figure 10:
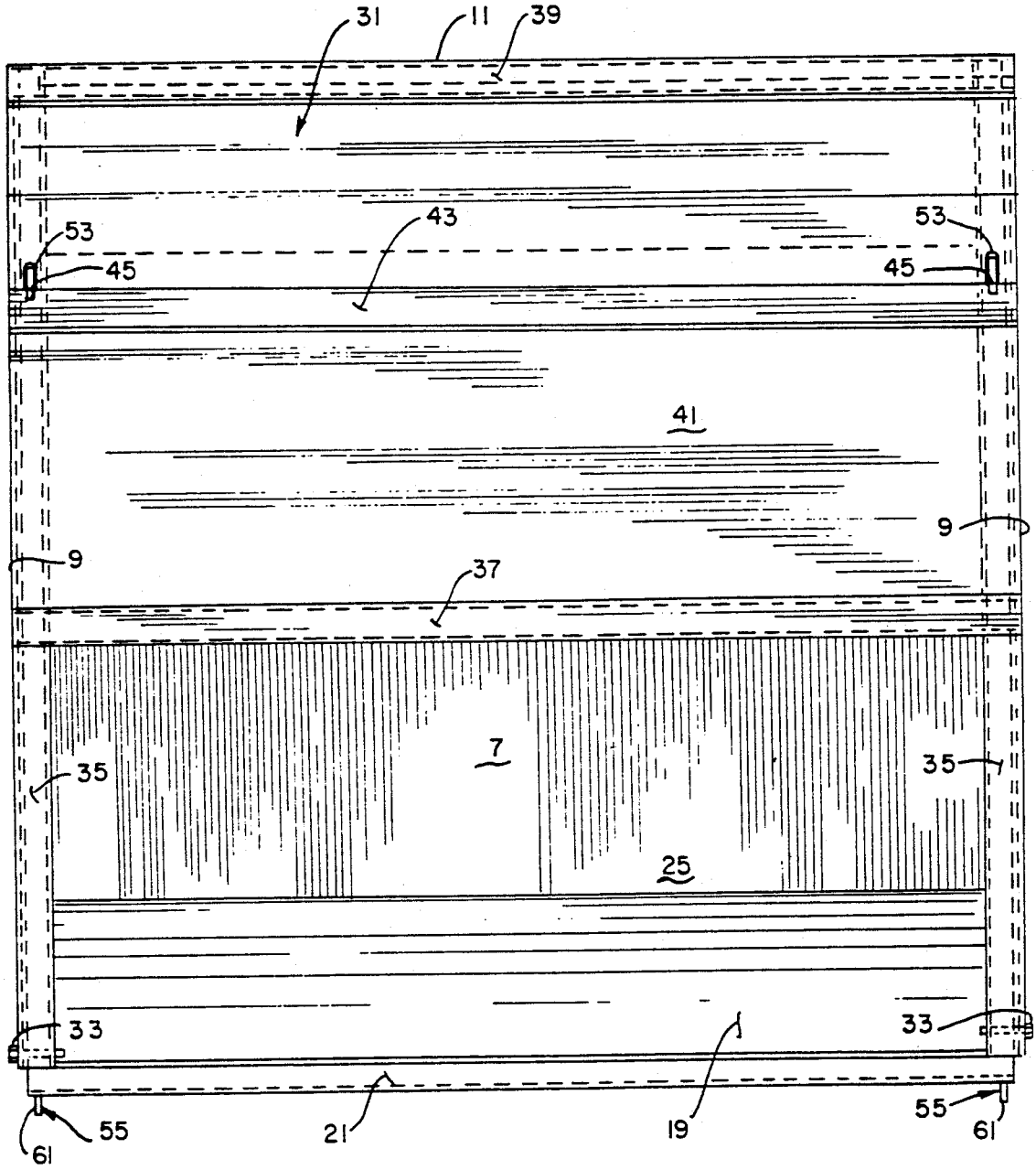
FIG. 10 is a top plan view of the waste material container by itself.

The supporting frame door 103 is operated by a pair of spaced pivotally mounted arms 105 which are attached at one end 107 to an upper portion of the door 103 and at an opposite end to spaced ears 109 which extend from the innerconnecting supporting beam 87. A torsional spring 111 is mounted to each of the spaced pivotally mounted arms 105 at one end thereof, and is attached at 113 to the supporting each ear 109 extending from the innerconnecting structural beam 87. The other end of the spring 111 is attached as at 115 to each pivotally mounted arm 105 generally along the midpoint thereof as best seen in FIGS. 1–2 of the drawings. This arrangement causes the supporting frame door 103 to be normally biased in an upper open position as shown in the drawings, until the force exerted by the torsional spring 111 provided on each generally mounted arm 105 is overcome by downward movement of the supporting door frame 103. For this purpose, the supporting frame 103 at a lower portion thereof is provided with spaced slidable elements 117, 117 which are received over vertically extending rods 119, 119 attached to the spaced structural legs supports 67, 67, as shown in FIGS. 3 and 5 of the drawings. A handle grip 121 is provided along the lower marginal edge of the supporting frame door 103 enabling an operator to overcome the torsional spring force and lower the door closing the front panel member opening.

It will be further noted that when the waste material container 3 is assembled relative to the compactor 5, the bumper 21 attached to the partial front wall panel 13 thereof supports the waste material container in balanced relationship relative to the activating rods 55 when the extended portions 61 thereof engage the structural leg supports 69, 69 as best seen in FIG. 2 of the drawings. Further, it will be seen that a corresponding upper projection 123, extending from each of the structural leg supports 69, 69 undergirds and supports the bumper 21 when the material container 3 and compactor 5 are assembled in the combined compactor and associated waste material container 1 relationship.

From the foregoing detailed description, it shall be appreciated that the above described embodiments illustrate the invention by way of example, and not by way of limitation. This description is sufficient to enable one skilled in the art to make and use the invention, and further describes several embodiments, adaptions, variations, alternatives and uses of the invention, including what is believed to be the best mode of carrying out the invention.

In view of the above, it will be seen that the several objects of the invention and other advantageous results are obtained.

I claim:

1. A compactor for waste material container, comprising:

a compactor supporting frame constructed for receiving the waste material container within said supporting frame, said supporting frame having a waste material channel extending therethrough;

said waste material container having an open upper end with a pivotally mounted cover extending at least partially across said open upper end, said waste material container also having a waste material opening which communicates with the waste material channel of said supporting frame when said waste material container is received within said supporting frame;

a waste compacting ram pivotally mounted at one end to said supporting frame and supported with respect to said waste material container for compacting waste therein;

cover locking means for holding said pivotally mounted cover in a closed, non-movable position relative tot he open upper end of said waste material container when received within said supporting frame;

said locking means comprises a pair of spring biased pivotally mounted locking levers which are mounted on opposite sides of said waste material container, an activating rod connected to each locking lever which is supported by said waste material container also on opposite sides thereof, each said activating rod being operably engaged by means associated with said supporting frame when said waste material container is received within said supporting frame to cause its associated locking lever to pivot into locking engagement relative to said cover against the force of the spring associated therewith; and a door connected to said supporting frame for closing the waste material channel during waste compaction.

2. The compactor as defined in claim 1 wherein said waste compacting ram is operable between an upper non-compacting position which provides clearance for waste material to be conveyed through said waste material channel into said waste material container and a lower compacting position where said waste compacting ram compacts waste in said waste material container.

3. The compactor as defined in claim 2 wherein said supporting frame includes spaced pairs of vertically extending structural leg supports on opposite sides of said supporting frame, and a spaced pair of hydraulic cylinders each being pivotally connected at one end to an interconnecting structural beam between one of said pairs of structural leg supports and with an opposite end of said spaced pair of hydraulic cylinders being pivotally connected to said waste compacting ram.

4. The compactor as defined in claim 3 wherein said pair of hydraulic cylinders operates in substantial alignment with said associated pair of structural leg supports.

5. The compactor as defined in claim 1 wherein each locking lever includes a hook portion for overlying part of the cover, and each activating rod extends beyond the waste material container for corresponding engagement with said supporting frame when positioned relative thereto to move each locking lever in locking position relative to said cover.

6. The compactor as defined in claim 1 wherein said waste material container includes complementary interlocking and interfitting means for maintaining said waste material container and said supporting frame assembled to one another.

7. A combined compactor and waste container, comprising:

a compactor supporting frame having spaced pairs of vertically extending structural leg supports on opposite sides thereof, said supporting frame including a housing positioned above a floor surface by said supporting leg supports, said housing including a waste material channel extending therethrough including a generally vertically directed side opening generally aligned with one spaced pair of vertically extending structural leg supports;

a waste material container having an open upper end portion and an open upper side portion which are complementary shaped relative tot he housing of said supporting frame for receiving the housing therein, said waste material channel of said housing being received within and being in direct communication with the open upper side portion of said waste material container, said waster material container also having an open upper end portion which extends laterally beyond said housing and over which is mounted a cover that is pivotally supported by said waste material container;

a waste compacting ram pivotally supported to said housing at one end ad being movable between an upper non-compacting position which provides clearance of waste material to be conveyed through said waste material channel into said waste material container and a lower compacting position where said waste compacting ram compacts waste in said waste material container, said waste compacting ram being operated adjacent an interior trash deflector shield that maintains trash below a predetermined level while assisting in trash compaction;

spring biased locking lever means pivotally mounted on opposite sides of said waster material container each normally biased in a non-locking position and including an activating rod connected thereto for engaging one pair of structural leg supports when said waste material container is operably associated relative to said supporting frame, each said activating rod causing said locking levers to pivot to a locking position for engaging and holding said pivotally mounted cover in closed, non-movable relationship to the open upper end portion of said waste material container which extends laterally beyond the housing of said supporting frame; and a normally open door connected to said supporting frame for closing the waste material channel during waste compaction.

8. The compactor as defined in claim 7 including a pair of spaced hydraulic cylinder pivotally connected at one end to an interconnecting beam between one pair of structural leg supports and pivotally connected at an opposite end to said waste compacting ram, said pair of hydraulic cylinders being operated in substantial alignment as said associated pair of structural leg supports.

9. The compactor as defined in claim 8 wherein said door includes a pair of spaced pivotally mounted arms attached to an upper area of said supporting frame and having springs connected to said pivotally mounted arms and said supporting frame, said door being connected adjacent an upper portion thereof to the other end of said pair of spaced pivotally mounted arms and said door being constrained adjacent a lower portion thereof to move in a substantially vertically extending path generally aligned with said other pair of spaced structural leg opening of said waste material channel.

10. The compactor as defined in claim 9 wherein said other pair of spaced structural leg supports includes cooperating slide means for receiving slidable elements attached to a lower portion of said door for said aforementioned constrained movement.

11. The compactor as defined in claim 10 wherein said waste material container and said supporting frame include complementary interfitting elements for maintaining said waste material container and supporting frame in the desired assembled relationship to one another.

12. The compactor as defined in claim 11 wherein said waste material container includes a bumper attached thereto in spaced relationship to said supporting frame when said activating rods operably engage said locking levers, said bumper also being supported by extensions from one of said pair of structural leg supports.

13. A container for use in a trash, said enclosure including at least a top wall and an end wall, said top wall having an opening in it, said container having a cover moveably mounted with respect to it, said cover at least partially closing the opening in said top wall, said end wall having a trash receiving opening in it for communicating with the trash receiving volume defined by said enclosure; and;

cover locking means for holding said moveably mounted cover in a closed, non-moveable position relative to the opening in said top wall of said container, said locking means including a pair of spring biased locking levers which are mounted in spaced relationship with respect to one another, each locking lever being normally biased in one of either a locking or non-locking position relative to said cover, said cover including engagement means interconnectable with said locking levers for actuation thereby.

14. A combined compactor and waste material container comprising:

a compactor supporting frame constructed for receiving the waste material container within the supporting frame, said compactor supporting frame having a waste material channel extending through the supporting frame and including a generally vertically extending front opening for receiving trash, a door for closing the generally vertically extending front opening during compaction;

said waste material container having a waste material opening including front opening means with a lower marginal edge that is generally aligned with a lower marginal edge of the generally vertically extending front opening of said compactor supporting frame, said waste material opening also having top opening means which communicates with said front opening means to provide a waste material channel between said compactor supporting frame and said waste material container for transporting trash to said waste material container; and a waste compactor ram supported by said compactor supporting frame and mounted for movement with respect to said waste material channel for compacting trash in said waste material container.

15. The combined compactor and waste material container as defined in claim 14 wherein said waste compactor ram is pivotally mounted to said waste compactor frame for movement through said waste material channel for compacting waste.

16. The combined compactor and waste material container as defined in claim 14 and including a reinforced lower marginal edge of said front opening means which engages structural elements of said compactor supporting frame to reinforce said waste material container during compaction.

17. The combined compactor and waste material container as defined in claim 14 wherein said waste material container and said waste compactor frame include complementary interlocking means for automatically interlocking said waste material container and said frame when assembled to one another.

18. The combined compactor and waste material container as defined in claim 14 wherein said waste material container includes an open upper end with a pivotally mounted cover extending at least partially across said open upper end, and cover locking means for holding said pivotally mounted cover in a closed, non-movable position relative to said one upper end when received within said waste compactor frame.

19. The combined compactor and waste material container as define din claim 18 wherein said locking means comprises a pair of spring biased pivotally mounted locking levers which are mounted on opposite sides of said waste material container, an activating rod connected to each locking lever which is supported by said waste material container also on opposite sides thereof, each said activating rod being operably engaged by means associated with said supporting frame when said waste material container is received within said supporting frame to cause its associated locking lever to pivot into locking engagement relative to said cover against the force of the spring associated therewith.

* * * * *

UNITED STATES PATENT AND TRADEMARK OFFICE

CERTIFICATE OF CORRECTION

PATENT NO. : 5,083,510

DATED : January 28, 1992

INVENTOR(S) : Kenneth W. Hohlt

It is certified that error appears in the above-identified patent and that said Letters Patent is hereby corrected as shown below:

Claim 1, column 10, line 17 is "tot he opening",
should be -- to the open--.

Claim 7, column 11, line 19 is "container, said waster",
should be -- container, said waste --;

column 11, line 25 is "at one end ad being",
should be -- at one end and being --;

column 11, line 27 is "of waste",
should be -- for waste --;

column 11, line 37 is "said waster",
should be -- said waste --;

Claim 9, column 12, line 2 is "leg opening",
should be -- leg supports for closing the generally vertically extending front opening --;

Claim 13, column 12, line 21 is "trash, said",
should be -- trash compacting system comprising;
¶ an enclosure defining a volume for receiving trash, said --;

Claim 18, column 14, line 2 is "one upper end",
should be -- open upper end --; and

UNITED STATES PATENT AND TRADEMARK OFFICE

CERTIFICATE OF CORRECTION

PATENT NO. : 5,083,510

DATED : January 28, 1992

INVENTOR(S) : Kenneth W. Hohlt

It is certified that error appears in the above-identified patent and that said Letters Patent is hereby corrected as shown below:

Claim 19, column 14, line 6 is "as define din", should be -- as defined in--.

Signed and Sealed this

Thirtieth Day of November, 1993

*Attest:*

*Attesting Officer*

BRUCE LEHMAN

*Commissioner of Patents and Trademarks*